US006017168A

United States Patent [19]

Fraser, Jr. et al.

[11] Patent Number: 6,017,168

[45] Date of Patent: Jan. 25, 2000

[54] FLUID ASSIST BEARING FOR TELESCOPIC JOINT OF A RISER SYSTEM

[75] Inventors: Thomas A. Fraser, Jr., Ventura, Calif.; Anh D. Nguyen; Derek C. Kennedy, both of Houston, Tex.

[73] Assignee: ABB Vetco Gray Inc., Houston, Tex.

[21] Appl. No.: 08/995,300

[22] Filed: Dec. 22, 1997

[51] Int. Cl.[7] ..... E02D 5/62; F16C 27/00

[52] U.S. Cl. ..... 405/224.4; 405/195.1; 405/224; 405/223.1; 166/359; 166/367; 384/99; 384/124

[58] Field of Search ..... 405/223, 223.1, 405/224, 224.1, 224.2, 224.3, 224.4, 225, 195.1; 166/337, 350, 359, 367; 384/99, 121, 124

[56] References Cited

U.S. PATENT DOCUMENTS

| | | | |
|---|---|---|---|
| 1,117,504 | 11/1914 | Kingsbury | 384/307 |
| 3,165,365 | 1/1965 | Wiedemann et al. | 384/121 |
| 3,393,026 | 7/1968 | Gregson . | |
| 3,508,419 | 4/1970 | Cargile, Jr. | 405/195.1 |
| 3,813,133 | 5/1974 | Walter et al. . | |
| 4,616,708 | 10/1986 | Da Monta | 166/355 |
| 4,617,998 | 10/1986 | Langner | 166/367 X |
| 4,733,991 | 3/1988 | Myers | 405/224.2 |
| 4,883,387 | 11/1989 | Myers et al. | 405/224.4 |
| 5,160,219 | 11/1992 | Arlt | 405/224.4 X |
| 5,169,265 | 12/1992 | Butler et al. | 405/224.4 |
| 5,188,375 | 2/1993 | Pope et al. | 384/99 X |
| 5,207,511 | 5/1993 | Bobo | 384/99 |
| 5,479,990 | 1/1996 | Peppel | 166/350 |
| 5,628,586 | 5/1997 | Arlt, III | 166/367 X |
| 5,730,531 | 3/1998 | Pinkos et al. | 384/99 |
| 5,846,028 | 12/1998 | Thory | 405/224 X |

*Primary Examiner*—David Bagnell
*Assistant Examiner*—Jong-Suk Lee
*Attorney, Agent, or Firm*—James E. Bradley

[57] ABSTRACT

An undersea telescopic joint for a riser system is connected to a drilling vessel with a plurality of tensioners. The joint has a bearing with inner and outer annular mating members. A cap seals the outer member to the joint. The outer member closely receives and is axially movable relative to the inner member. A flat thrust bearing is located in a chamber between the two members. The members are sealed to one another with upper and lower swivel seals. A passage communicates hydraulic fluid to the chamber. The bearing has a pressure gage which registers with a passage that extends between the swivel seals. The chamber is filled with hydraulic fluid so that the two members are separated and the drilling vessel may rotate easily. The gage is used to detect whether the primary swivel seal is leaking.

18 Claims, 3 Drawing Sheets

FLUID ASSIST BEARING FOR TELESCOPIC JOINT OF A RISER SYSTEM

TECHNICAL FIELD

This invention relates in general to an undersea telescopic joint and in particular to a fluid-assisted bearing for a telescopic joint.

BACKGROUND ART

Floating offshore drilling vessels utilize an undersea riser system with a fixed length which extends from the surface to the sea floor. A telescopic joint at the upper end of the riser is used to compensate for swells in the open sea which vary the vertical distance between the drilling vessel and the sea floor. Tensioners extend from the vessel to the riser to hold it in tension. The tensioners include a collar or ring which surrounds and supports the riser at the telescopic joint. Tension cables or cylinders extend from the support ring to the vessel. The tension cables maintain tension and compensate for vertical movement of the vessel relative to the riser.

At times, the drilling vessel must be rotated to compensate for changing surface conditions, such as changes in the current or wind, in order to maintain the drilling vessel in position over the drilling site. During such rotations, the tensioners and supporting ring will rotate with the vessel relative to the telescopic joint. The riser system must be kept under tension during the rotation. A bearing is located between the support ring and the telescopic joint to accommodate the rotation. Although various bearings have been designed for telescoping joints, an improved bearing which better facilitates the rotation of undersea telescopic joints while maintaining high tension capacities is needed.

DISCLOSURE OF THE INVENTION

An undersea telescopic joint for a riser system is connected to a drilling vessel with a plurality of tensioners. The telescopic joint has a bearing with inner and outer annular mating members. A cap seals the outer member to the telescopic joint. The outer member rotates relative to the inner member. The outer member rotates with the drilling vessel while the inner member remains stationary with the riser. The inner and outer members are sealed to one another with upper and lower swivel seals. A passage communicates hydraulic fluid to the chamber. The bearing has a pressure gage which registers with a passage that extends between the swivel seals. The chamber is filled with hydraulic fluid so that the two members are separated and the drilling vessel may rotate easily. The gage is used to detect whether the primary swivel seal is leaking.

BEST MODE FOR CARRYING OUT THE INVENTION

Figure 1:
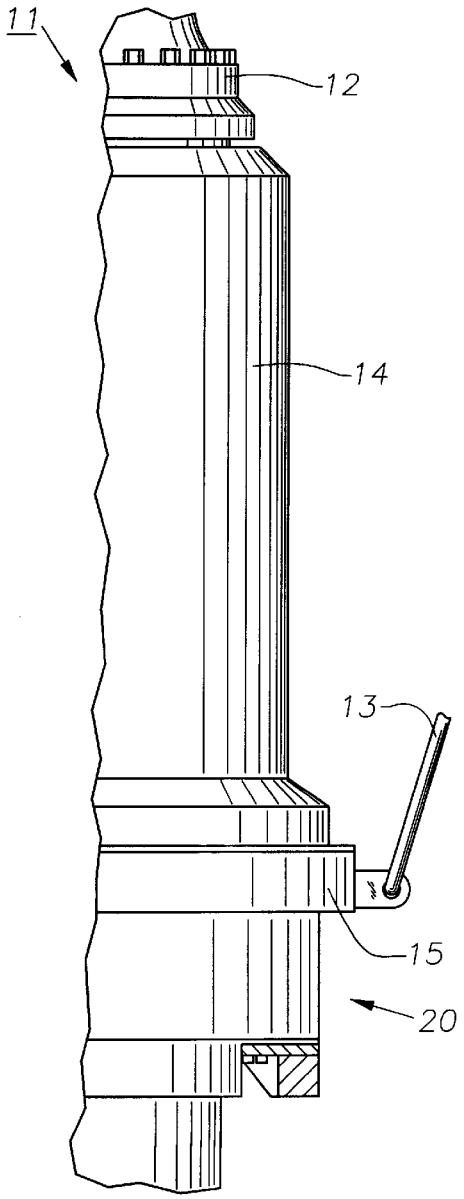
FIG. 1 is half of a side view of a telescopic joint constructed in accordance with the invention.

Referring to FIG. 1, an undersea telescopic joint 11 for a floating offshore drilling vessel is shown. A riser system (not shown) extends rigidly upward from the sea floor to the drilling vessel. Joint 11 is installed in the riser system to compensate for swells in the open sea which vary the vertical distance between the drilling vessel and the sea floor. Joint 11 has an inner barrel 12 and an outer barrel 14 which telescope relative to one another. Inner barrel 12 is mounted to the drilling vessel for movement therewith. Outer barrel 14 is secured to the upper end of the riser system which extends down to the well.

The drilling vessel has a plurality of riser tensioners or cables 13 which extend downward and are fastened to outer barrel 14 of joint 11. The tension cables 13 provide a uniform upward pull on outer barrel 14 despite wave movement to apply tension to the riser. A support ring 15 supports outer barrel 14 of joint 11. Tensioners 13 and support ring 15 rotate with the drilling vessel when it turns, but the riser and outer barrel 14 will not rotate.

Figure 2:
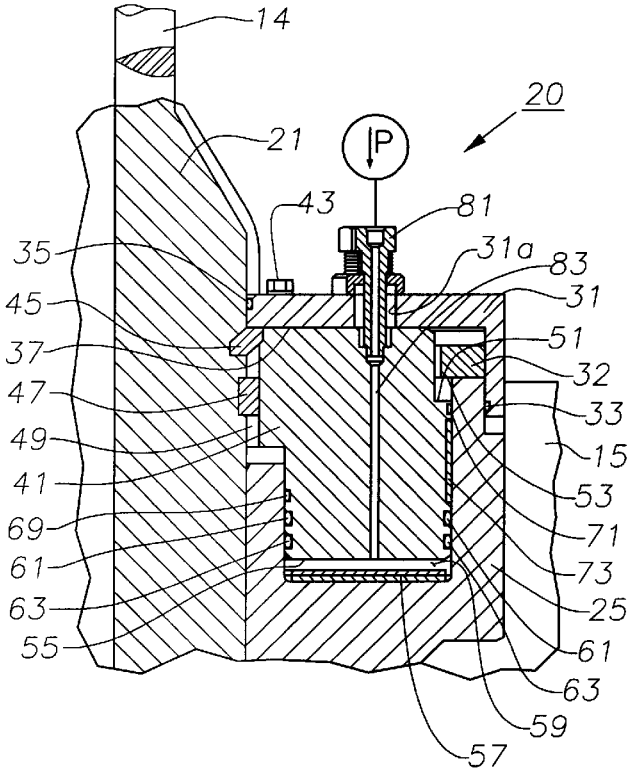
FIG. 2 is a partial, first sectional side view of a first embodiment of a bearing for the telescopic joint of FIG. 1.
Figure 3:
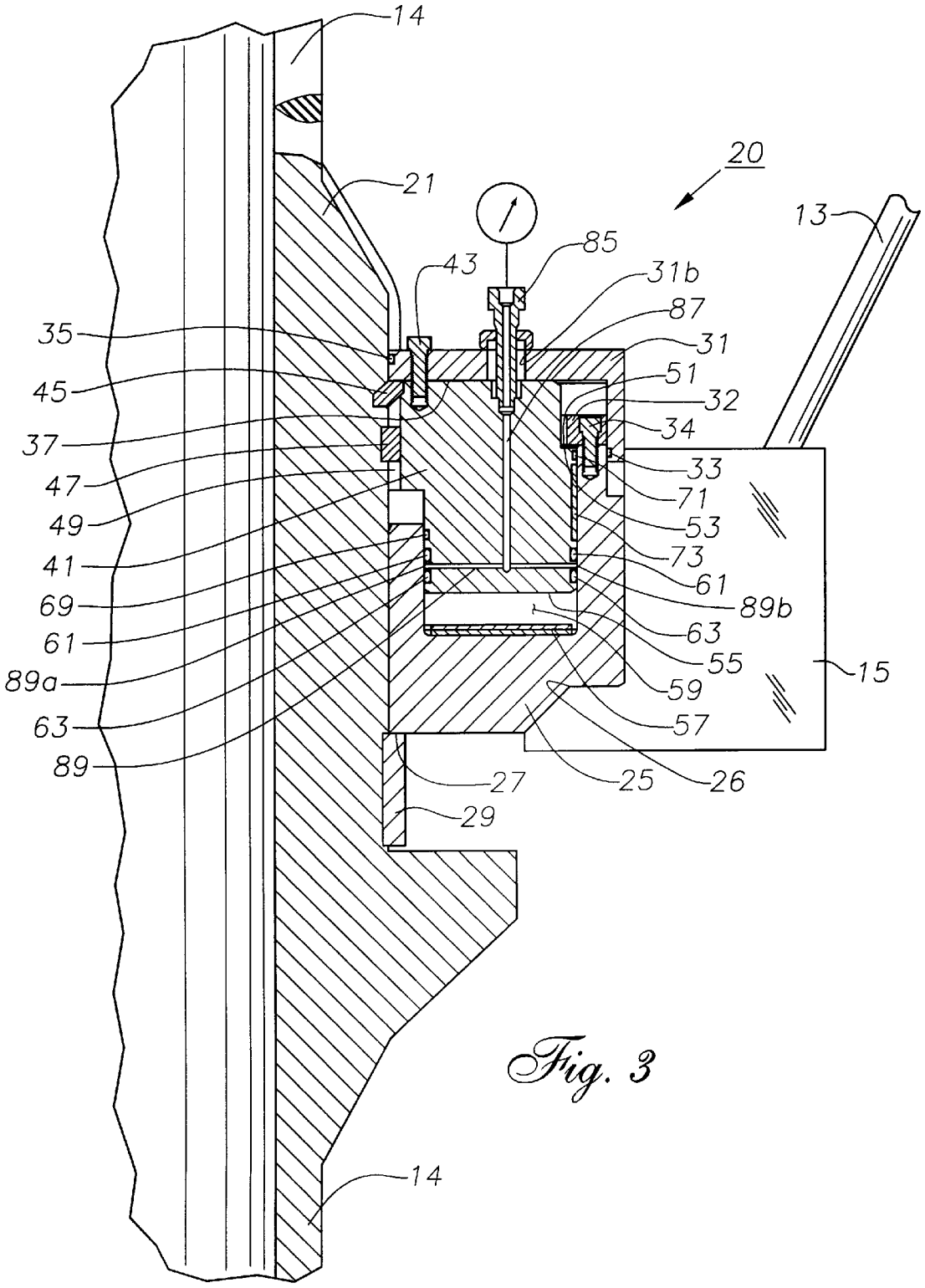
FIG. 3 is an enlarged, second sectional side view of the bearing of FIG. 2.

A first embodiment of a rotary bearing for accommodating the rotation of joint 11 is shown in FIGS. 2 and 3. Bearing 20 has a generally cylindrical riser sleeve 21 is welded to outer barrel 14. A second annular member 25 is located between support ring 15 and riser sleeve 21 and is rotatable and axially movable relative to sleeve 21. Support ring 15 has an inner lip 26 which faces upward and engages a lower side of member 25 (FIG. 3). Member 25 has a lower end 27 which lands on a stop ring 29 while in a lower position for limiting the downward movement of member 25 relative to sleeve 21. FIG. 2 shows member 25 in an upper position. A cap 31 slidingly engages an upper outer portion of member 25. Cap 31 does not rotate because it is tied to member 45 which is tied to member 21 through anti-rotation key 47. A seal 33 is located between member 25 and cap 31. A radial inner surface of cap 31 engages and is sealed to sleeve 21 with a seal 35.

A generally rectangular annular cavity 37 is defined between riser sleeve 21, member 25 and cap 31. A first annular member 41 is located within cavity 37 and fastened to cap 31 with bolts 43 (FIG. 3). Sleeve 21, cap 31 and member 41 interlock rib 45. Rib 45 axially locks member 41 to sleeve 21, preventing any axial movement therebetween. An anti-rotation key 47 extends radially outward from sleeve 21 into a slot 49 on a radially inner surface of member 41 to prevent rotation therebetween. Member 25 closely receives and is axially movable relative to member 41. A retention ring 32 is mounted to the upper outer end of member 25 with bolts 34 (FIG. 3). The downward travel of member 25 is limited when shoulder 53 of retention ring 32 engages upward facing shoulder 51 of member 41 and when lower side 27 of member 25 contacts stop 29. A flat thrust bearing 57 is located in a chamber 59 in member 25. In the preferred embodiment, bearing 57 is fabricated from TEFLON and is provided as a back-up bearing for reducing the friction between member 25 and member 41 should they make contact in the event the fluid in chamber 59 leaks.

Member 41 has a number of seals located along its radial inner and outer surfaces which seal chamber 59 to member 25. Member 41 has a pair of upper and lower swivel seals 61, 63 on each of its inner and outer diameters. Member 41 also has an upper trash seal 69 on its inner diameter, and another upper trash seal 71 on its outer diameter. A cylindrical bearing sleeve 73 is seated on the outer diameter of member 41 between upper seal 71 and swivel seal 61 to reduce friction between housings 25, 41 during rotation.

Referring now to FIG. 2, bearing 20 has a high pressure valve 81 which extends through a hole 31a in cap 31. Valve 81 extends downward into member 41 and registers with a vertical passage 83. Passage 83 extends completely through member 41 between its upper and lower surfaces. Passage 83 is provided for communicating hydraulic fluid between valve 81 and chamber 59. Valve 81 allows hydraulic fluid to be injected into chamber 59 below member 41 and prevents outflow through passage 83.

As shown in FIG. 3, bearing 20 also has a pressure gage 85 which extends through hole 31*b* in cap 31. Gage 85 extends downward into member 41 and registers with a vertical monitoring passage 87. Passage 87 extends toward the lower end of member 41 where it intersects a horizontal passage 89. Passage 89 has ports 89*a*, 89*b* on the radial inner and outer sides of member 41, respectively. Ports 89*a*, 89*b* are located between swivel seals 61, 63. Gage 85 and its passages 87 are circumferentially spaced apart from valve 81 and its passages 83. Passages 87, 89 do not directly communicate with chamber 59 below member 41, rather, they sense any pressure between seals 61, 63.

In operation, bearing 20 is only used when the drilling vessel rotates relative to the riser system. Chamber 59 is normally filled with hydraulic fluid (FIG. 3) so that separation is maintained between surface 55 and bearing 57. At installation, hydraulic fluid is injected through valve 81. The fluid travels through passage 83 and into chamber 59 where it is sealed from leakage by swivel seals 61,63. The highly pressurized fluid places bearing 20 in a charged state wherein member 25 is forced slightly downward relative to member 41 (FIG. 3).

Tensioners 13 exert an upward force on outer member 25. The force passes through the hydraulic fluid and acts against member 41. Member 41 transmits the upward force through rib 45 to sleeve 21, outer barrel 14 and thus the riser extending to the well. Tensioners 13 maintain a fairly constant upward force even though the vessel may be moving relative to support ring 15 due to wave movement at the surface. The pressure in chamber 59 is due to the upward pull by tensioners 13. Member 25 and the drilling vessel may rotate easily relative to the remaining components of bearing 20 and the riser system because of the fluid cushion. Optionally, bearing 20 may be maintained in an uncharged state during nonuse wherein chamber 59 is not pressurized with hydraulic fluid and lower surface 55 of member 41 is at rest near or on top of thrust bearing 57 (FIG. 2).

Gage 85 is used to detect whether primary swivel seal 63 is working properly when bearing 20 is in the charged state. When bearing 20 is working properly, a sealed chamber exists below primary seals 63, and gage 85 will not detect pressure between seals 61, 63. The pressure in chamber 59 below seal 63 will not be detected. However, if primary seal 63 is leaking fluid, the fluid will flow into passages 89, through passages 87, and up to gage 85 where the leak from chamber 59 will be detected. Gage 85 would read the pressure in chamber 59 in that event. When redundant seal 61 is working properly, it will still hold fluid pressure in chamber 59. However, if seal 61 also leaks and if all of the hydraulic fluid in chamber 59 escapes, bearing 57 will land on surface 55 of member 41 to provide support for rotation.

Figure 4:
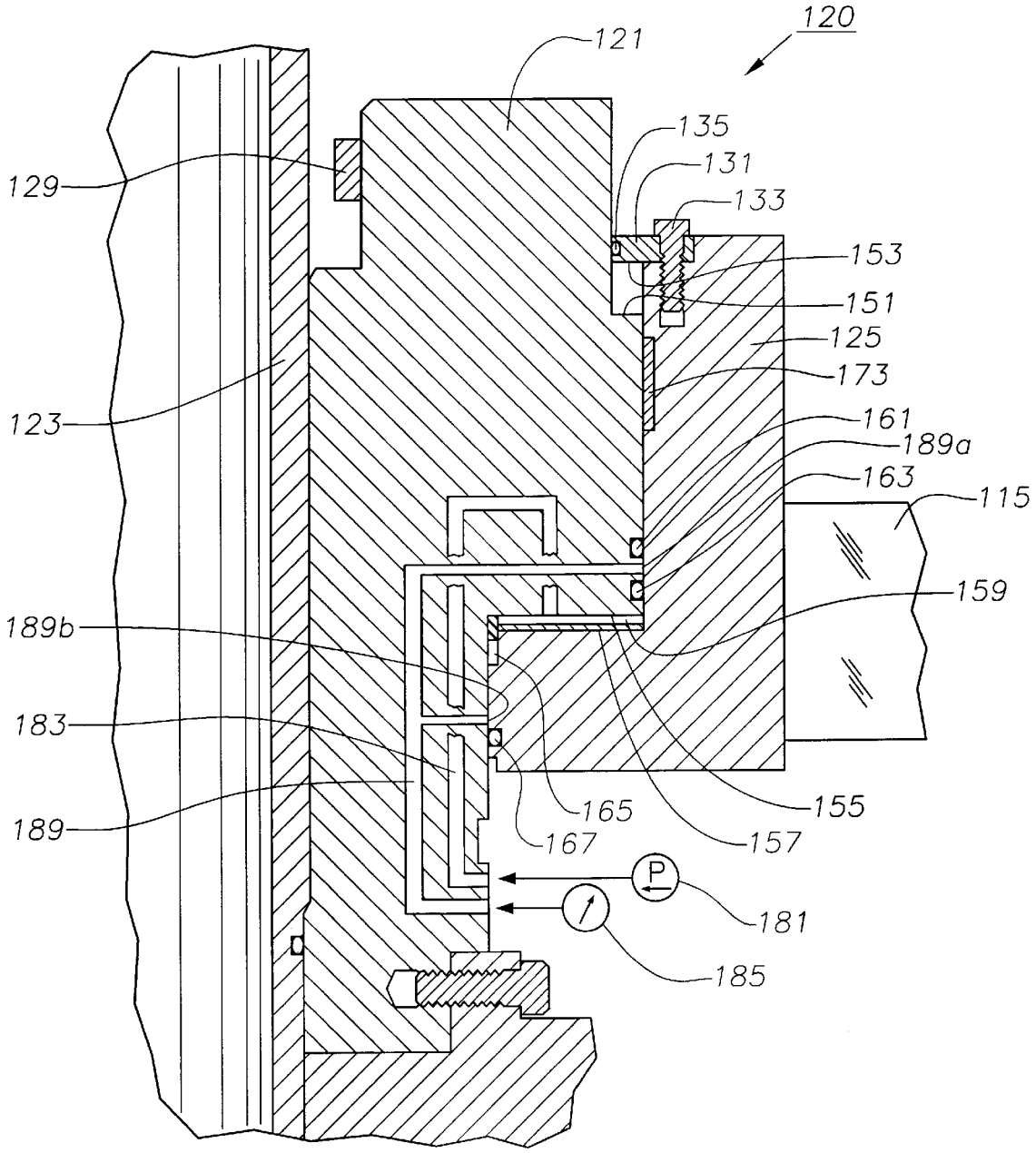
FIG. 4 is an enlarged, partial sectional side view of a second embodiment of a bearing for the telescopic joint of FIG. 1.

Referring now to FIG. 4, a second embodiment of the invention is shown. Bearing 120 has a first annular member 121 which closely receives and supports an outer barrel 123 of a telescoping joint. Outer barrel 123 is not rotatable relative to member 121 by way of a key (not shown). Lugs 129 are located on an upper inner diameter portion for handling with a lifting tool during installation. A support ring or second annular member 125 supports member 121. Member 125 has an L-shaped cross-section which closely receives member 121. Lugs 115 are mounted to member 125 and are connected to tensioners (not shown) which extend to the vessel. A retainer ring 131 is mounted to the upper outer end of member 125 with bolts 133. Retainer ring 131 has a seal 135 on its inner surface for sealing to member 121.

Member 121 and member 125 closely receive and engage one another along their outer and inner surfaces, respectively, although they are able to move vertically and rotationally relative to one another. The upward travel of member 125 relative to member 121 is limited when its radially outer shoulder 151 engages a downward facing shoulder 153 on landing ring 131. The downward travel of member 125 is limited when its horizontal surface 155 lands on a flat thrust bearing 157 located in a chamber 159 between member 121 and member 125. In the preferred embodiment, bearing 157 is fabricated from TEFLON and is provided as a back-up bearing for reducing the friction between member 125 and member 121 should they make contact.

Housings 121, 125 have a number of seals located along their radial outer and inner surfaces, respectively, which seal chamber 159. Member 121 has upper and lower swivel seals 161, 163 which seal the upper end of chamber 159. Member 125 has upper and lower swivel seals 165, 167 which seal the lower end of chamber 159. A vertically oriented bearing ring 173 is seated in member 125 between seal 135 and swivel seal 161 to reduce friction between housings 121, 125 during rotation.

Bearing 120 has a high pressure valve 181 which registers with a passage 183 in housing 121. Passage 183 extends through housing 121 to chamber 159 for communicating hydraulic fluid between valve 181 and chamber 159. Bearing 120 also has a pressure gage 185 which registers with a monitoring passage 189 in housing 121. Passage 189 has ports 189*a*, 189*b* on the radial outer side of member 121. Port 189*a* is located between swivel seals 161, 163, while port 189*b* is located between swivel seals 165, 167. Gage 185 and passage 189 are circumferentially spaced apart from valve 181 and passage 183.

In operation, bearing 120 operates similarly to bearing 20. Hydraulic fluid is injected through valve 181 into chamber 159. The fluid travels through passage 183 and into chamber 159 where it is sealed from leakage by swivel seals 163, 165. An upward force is applied by the tensioners, tending to cause member 125 to move upward relative to member 121. This load increases the pressure in chamber 159. FIG. 4 shows chamber 159 empty with member 125 in an upper position relative to member 121. When bearing 120 is in a charged state, member 125 and the liquid in chamber 159 allow the drilling vessel to rotate easily relative to the remaining components of bearing 120 and the riser system.

Gage 185 is used to detect whether swivel seals 163, 165 are working properly when bearing 120 is in the charged state. When bearing 120 is working properly, chamber 159 operates as a sealed chamber between seals 163, 165, and gage 185 will not detect pressure between each pair of swivel seals 161, 163 and 165, 167. However, if either or both primary seals 163, 165 are leaking fluid, fluid pressure in passage 189 will be detected by gage 185. When functioning properly, redundant seals 161, 167 will still hold pressure in chamber 159. If seals 161 or 167 fail, thrust bearing 157 will facilitate rotation.

The invention has several advantages. The bearing is capable of carrying both high bearing loads and providing low torsional resistance. The use of a fluid assisted bearing on the telescopic joint allows the riser system to sustain high tension loads while reducing frictional resistance during vessel rotation. The primary seals may be monitored to determine if leakage occurs. If so, secondary seals serve as a back-up until replacements are made. Smooth bearing surfaces serve as a third back-up.

While the invention has been shown or described in only some of its forms, it should be apparent to those skilled in the art that it is not so limited, but is susceptible to various changes without departing from the scope of the invention.

I claim:

1. In a floating offshore drilling vessel having a riser system with an axis extending between the sea floor and the drilling vessel, a telescopic joint in the riser system having a rotary bearing, and a plurality of riser tensioners extending from the drilling vessel to an outer barrel of the joint for exerting an upward force to apply tension to the riser system, the rotary bearing comprising:

a first annular member which engages the outer barrel of the telescopic joint, the first annular member being nonrotational relative to the outer barrel;

a second annular member slidingly engaging the first annular member, the first and second annular members being rotatable relative to each other and axially movable relative to each other for a limited amount; and a sealed chamber located between the first annular member and the second annular member and defined by a downward facing portion of the first annular member and an upward facing portion of the second annular member, the chamber containing hydraulic fluid to provide a fluid cushion for allowing the second annular member to rotate relative to the first annular member while the second annular member exerts an upward force on the first annular member through the tensioners.

2. The bearing of claim 1, further comprising a passage extending from the chamber to an external port, the passage communicating hydraulic fluid from the external port to the chamber.

3. The bearing of claim 1, further comprising a monitoring passage extending through one of the annular members for detecting leakage of hydraulic fluid from the chamber.

4. The bearing of claim 1, further comprising:

a primary seal located between the first and second annular members for sealing the chamber;

a secondary seal located between the first and second annular members adjacent to the primary seal for sealing the chamber; and a monitoring passage extending between the seals to the exterior of one of the annular members for monitoring any leakage of hydraulic fluid past the primary seal.

5. The bearing of claim 1, further comprising a thrust bearing on one of said portions of the first and second annular members in the chamber for reducing friction between the first annular member and the second annular member if all of the hydraulic fluid is depleted from the chamber.

6. The bearing of claim 1 wherein th second annular member has an annular cavity which closely receives the first annular member and the chamber is located within the annular cavity of the second annular member.

7. The bearing of claim 1, further comprising a cap mounted to the first annular member, the cap and the first annular member slidingly engaging the second annular member.

8. The bearing of claim 1 wherein second annular member has an L-shaped cross-section which closely receives the first annular member.

9. In a floating offshore drilling vessel having a riser system with an axis extending between the sea floor and the drilling vessel, a telescopic joint in the riser system having a rotary bearing, and a plurality of riser tensioners extending from the drilling vessel to an outer barrel of the joint for exerting an upward force to apply tension to the riser system, the rotary bearing comprising:

a first annular member which is stationarily mounted to the outer barrel of the telescopic joint;

a second annular member slidingly engaging the first annular member, the second annular member being rotatable and axially movable relative to the first annular member for a limited amount;

a sealed chamber located between the first annular member and the second annular member and defined by a downward facing portion of the first annular member and an upward facing portion of the second annular member, the chamber containing hydraulic fluid for keeping said portions of the annular members apart from each other and providing a fluid cushion for allowing the second annular member to rotate relative to the first annular member while the second annular member exerts an upward force on the first annular member through the tensioners;

a primary seal located between the first and second annular members for sealing the chamber; and a passage extending from the chamber to an external port, the passage communicating hydraulic fluid from the external port to the chamber.

10. The bearing of claim 9, further comprising a monitoring passage extending through one of the annular members for detecting leakage of hydraulic fluid from the chamber.

11. The bearing of claim 9, further comprising:

a secondary seal located between the first and second annular members adjacent to the primary seal for sealing the chamber; and a monitoring passage extending from between the seals to the exterior of the first annular member for detecting whether the primary seal is leaking.

12. The bearing of claim 9, further comprising a thrust bearing on one of said portions of the first and second annular members in the chamber for reducing friction between the first annular member and the second annular member if all of the hydraulic fluid is depleted from the chamber.

13. The bearing of claim 9 wherein second annular member has an annular cavity which closely receives the first annular member and the chamber is located within the annular cavity of the second annular member.

14. The bearing of claim 9, further comprising a cap mounted to the first annular member, the cap and the first annular member slidingly engaging the second annular member.

15. The bearing of claim 9 wherein second annular member has an L-shaped cross-section which closely receives the first annular member.

16. A method for rotating a telescopic joint in a riser system for a floating offshore drilling vessel, the riser system extending between the sea floor and the drilling vessel, comprising:

(a) providing a rotary bearing in the telescopic joint having a chamber defined between first and second annular members, the chamber being filled with hydraulic fluid to provide a fluid cushion therebetween and being sealed with a primary seal, and the first annular member being nonrotational relative to the riser system;

(b) securing a plurality of riser tensioners to the second annular member, the tensioners extending from the drilling vessel;

(c) exerting an upward force on the tensioners to apply tension to the riser system; and (d) rotating the drilling vessel relative to the riser system such that the second annular member rotates relative to the first annular member while the second annular member exerts an upward force on the first annular member through the fluid cushion.

17. The method of claim 16, further comprising the step of communicating hydraulic fluid from an external port to the chamber through a passage.

18. The method of claim 16, further comprising the step of providing a secondary seal in the chamber adjacent to the primary seal for monitoring the space between the secondary seal and the primary seal to detect leakage of hydraulic fluid.

* * * * *